US006379230B1

(12) United States Patent
Hayashi et al.

(10) Patent No.: US 6,379,230 B1
(45) Date of Patent: Apr. 30, 2002

(54) AUTOMATIC POLISHING APPARATUS CAPABLE OF POLISHING A SUBSTRATE WITH A HIGH PLANARIZATION

(75) Inventors: Yoshihiro Hayashi, Tokyo; Kazuo Kobayashi, Kanagawa, both of (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/066,760

(22) Filed: Apr. 28, 1998

(30) Foreign Application Priority Data

Apr. 28, 1997 (JP) ..... 9-111537

(51) Int. Cl.[7] ..... B24B 5/00

(52) U.S. Cl. ..... 451/292; 451/65; 451/57; 451/288; 451/287

(58) Field of Search ..... 451/288, 41, 287, 451/443, 444, 292, 411, 401, 403, 57, 65; 438/692

(56) References Cited

U.S. PATENT DOCUMENTS

| | | | | |
|---|---|---|---|---|
| 5,554,064 A | | 9/1996 | Breivogel et al. | |
| 5,609,511 A | | 3/1997 | Moriyama et al. | 451/8 |
| 5,611,943 A | | 3/1997 | Cadien et al. | |
| 5,651,724 A | | 7/1997 | Kimura et al. | 451/41 |
| 5,718,619 A | | 2/1998 | Merrill et al. | 451/292 |
| 5,792,709 A | | 8/1998 | Robinson et al. | 451/292 |
| 5,804,507 A | | 9/1998 | Perlov et al. | 438/692 |
| 5,830,045 A | | 11/1998 | Togawa et al. | 451/288 |
| 5,860,847 A | | 1/1999 | Sakurai et al. | 451/285 |
| 5,893,795 A | | 4/1999 | Perlov et al. | 451/288 |
| 5,902,173 A | | 5/1999 | Tanaka | 451/41 |
| 5,904,611 A | | 5/1999 | Takahashi et al. | 451/41 |
| 6,004,187 A | * | 12/1999 | Nyui et al. | 451/288 |
| 6,165,056 A | | 12/2000 | Hayashi et al. | 451/281 |
| 6,168,683 B1 | * | 1/2001 | Cesna | 451/285 |

FOREIGN PATENT DOCUMENTS

| | | |
|---|---|---|
| EP | 0150074 | 7/1985 |
| EP | 0180175 | 5/1986 |
| EP | 0272531 | 6/1988 |
| EP | 0738561 | 10/1996 |
| JP | 61-219570 | 9/1986 |
| JP | 62-162468 | 7/1987 |
| JP | 1-153273 | 6/1989 |
| JP | 5-36667 | 2/1993 |
| JP | 5-190518 | 7/1993 |
| JP | 6-120182 | 4/1994 |
| JP | 7-193033 | 7/1995 |
| JP | 7-276225 | 10/1995 |
| JP | 7-283177 | 10/1995 |
| JP | 8-288242 | 11/1996 |
| JP | 86048 | 4/1998 |
| KR | 7-45567 | 2/1995 |
| WO | 030308 | 9/1982 |

* cited by examiner

*Primary Examiner*—Joseph J. Hail, III
*Assistant Examiner*—Lee Wilson
(74) *Attorney, Agent, or Firm*—Sughrue Mion, PLLC

(57) ABSTRACT

An automatic polishing apparatus has an index table. A loading station, a primary polishing station, a secondary polishing station, and an unloading station are set along the circumference of an index table. The index table has a plurality of holders 2 each of which is for supporting a wafer. The index table is rotated so that rotational movement is given to each of the stations. The wafer is transferred to the loading station. The wafer is transferred from the loading station to the primary polishing station to be subjected to planarization process at the primary polishing station. The wafer is is subject to finish treatment at the secondary polishing station to be polished into a polished wafer which is transferred from the unloading station to an outside of the polishing apparatus.

35 Claims, 16 Drawing Sheets

AUTOMATIC POLISHING APPARATUS CAPABLE OF POLISHING A SUBSTRATE WITH A HIGH PLANARIZATION

BACKGROUND OF THE INVENTION

This invention relates to an automatic chemical mechanical polishing apparatus for polishing a substrate such as a semiconductor wafer having semiconductor device patterns.

In general, a polishing apparatus is known which is for polishing a substrate such as a semiconductor wafer having semiconductor device patterns. A conventional polishing apparatus comprises a polishing table equipped with a polishing pad and a wafer holding head for holding a wafer. The polishing table rotates at a rotating speed. The wafer is pressed onto the polishing pad at a constant pressure by lowering the wafer holding head in order to polishing the wafer. The polishing pad is refreshed by a polishing pad conditioner having fine diamond particles.

A pair of polishing tables may be used on polishing the wafer to improve a flatness and roughness of the processed surface. One of, polishing tables may be called a primary polishing table. Another one of polishing tables may be called a secondary polishing table. The primary polishing table has a crude (hard) polishing cloth as the polishing pad that is for use in a rough polishing. The secondary polishing table has a fine (soft) polishing cloth as rhe polishing pad that is for use in a final or finish polishing.

It is possible to increase the polishing speed of the wafer by increasing the polishing table rotation and the pressure on the wafer in the polishing pad. Inasmuch as scratching wounds or scars occurs on the wafer when the pressure on the wafer is too high, it is desirable that the pressure on the wafer in the polishing pad is low at a high rotating speed in order to suppress occurrence of the scratching wounds on the wafer.

The conventional polishing apparatus comprises a large-diameter polishing table compared with a diameter of the wafer. It is impossible to rotate the large-diameter polishing table at the high speed under the low polishing pressure. In addition, the diamond particles drop out of the polishing pad conditioner onto the polishing pad refreshing the polishing pad, inasmuch as the polishing pad is directed upwardly. The diamond particles dropped out of the polishing pad conditioner onto the polish pad, scratch and wound the surface of the wafer.

As described above, the primary and the secondary polishing tables may be used for highly precise polishing of the wafer. More specifically, both of the primary and the secondary polishing tables are rotated to polish the wafer. The wafer is pressed and rotated onto the primary polishing table to obtain a roughly polished wafer. The primary polished wafer is pressed and rotated onto the secondary polishing table to execute a final polishing.

In as much as the primary and secondary polishing tables are considerably large in diameter as compared to that of the wafer, the use of such large-size polishing tables would result in an increase in occupation area within factory space. This means that the space utility efficiency is reduced. Especially, the diameters of the primary and the secondary polishing tables tend to increase as the diameter of the wafer increases from 4 through 6 inches to 8 through 12 inches.

Furthermore, it is necessary to use an amount of abrasive liquid in order to uniformly lay the abrasive fluid over the entire surface of each of primary and the secondary polishing tables. On using an amount of abrasive liquid, running cost increases. An environmental problem occurs on disposing the used abrasive fluid as a waste product. In addition, a loss of time occurs in the conventional polishing apparatus inasmuch as it is necessary to transfer the wafer from the primary polishing table to the secondary polishing table.

More specifically, the wafer is gripped by a first chuck to be pressed onto the primary polishing table with abrasive fluid. On transferring the wafer from the primary polishing table to the secondary polishing table, it is necessary to release the wafer from the first chuck in order to attach the wafer to a second chuck which is associated with the secondary polishing table. When it takes a long time to attach the wafer to the second chuck, the abrasive fluid residing on the wafer dries. When the abrasive fluid dries, scratch traces may occur on the wafer. Furthermore, the wafers may be inevitably etched. In addition, it is impossible to watch the polishing surface of the wafer inasmuch as the polishing surface is directed to each of the primary and the secondary polishing tables downwardly. As a result, it is difficult to watch aspects of the wafer during polishing process. second chuck which is associated with the secondary polishing table. When it takes a long time to attach the wafer to the second chuck, the abrasive fluid residing on the wafer dries. When the abrasive fluid dries, scratch traces may occur on the wafer. Furthermore, the wafers may be inevitably etched. In addition, it is impossible to watch the polishing surface of the wafer inasmuch as the polishing surface is directed to each of the primary and the secondary polishing tables downwardly. As a result, it is difficult to watch aspects of the wafer during polishing process.

SUMMARY OF THE INVENTION

It is therefore an object of this invention to provide an automatic polishing apparatus capable of polishing a wafer with a high planarization.

According to this invention, the automatic polishing apparatus comprises:

(A) an index table for holding at least two wafers as first and second wafers at first and second predetermined locations, respectively, the index table being given a rotation at a predetermined angle around a predetermined rotation axis, each of the first and the second wafers having front surface which is directed upwardly, (B) at least one polishing station which is positioned at a first stop position of the index table, the polishing station being a region for use in polishing each of the first and the second wafers into the polished wafer, and (C) a polishing head located above the index table at the polishing station, the polishing head having a polishing surface which is for polishing the front surface of each of the first and the second wafers transferred to the polishing station.

DESCRIPTION OF THE PREFERRED EMBODIMENT

Figure 1A:
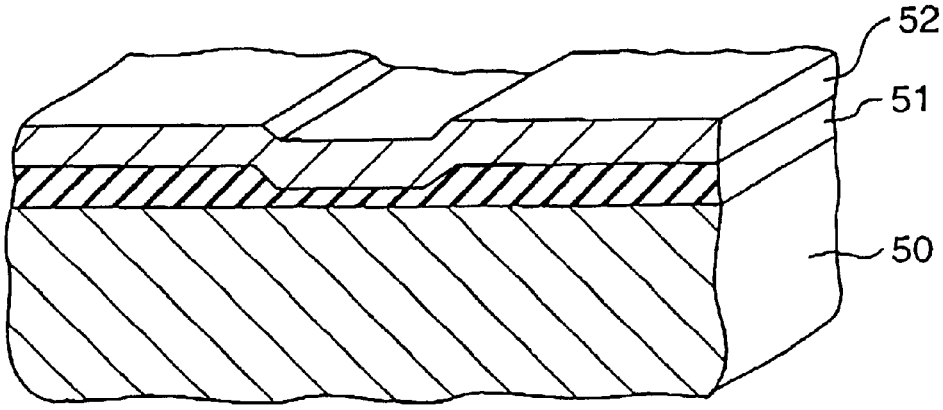
FIG. 1A PRIOR ART
FIGS. 1A and 1B show views each of which is a lead-wire structure of a wafer;.
Figure 1B:
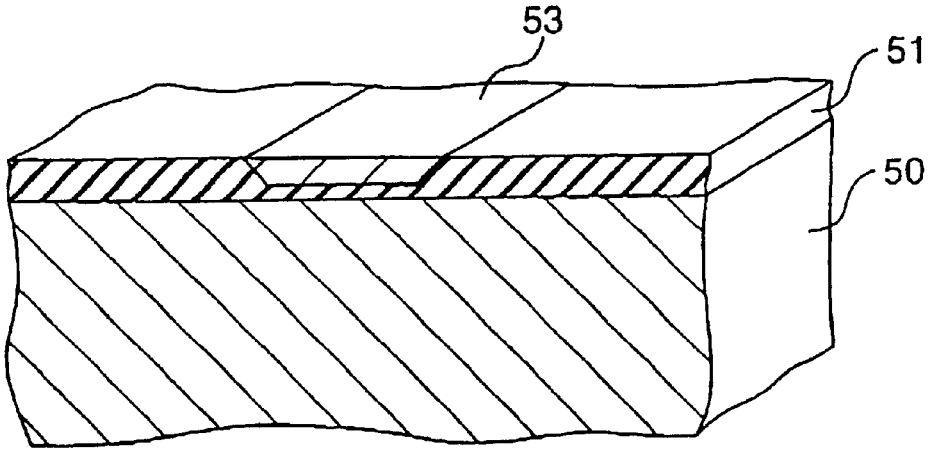
FIG. 1B PRIOR ART
Figure 2:
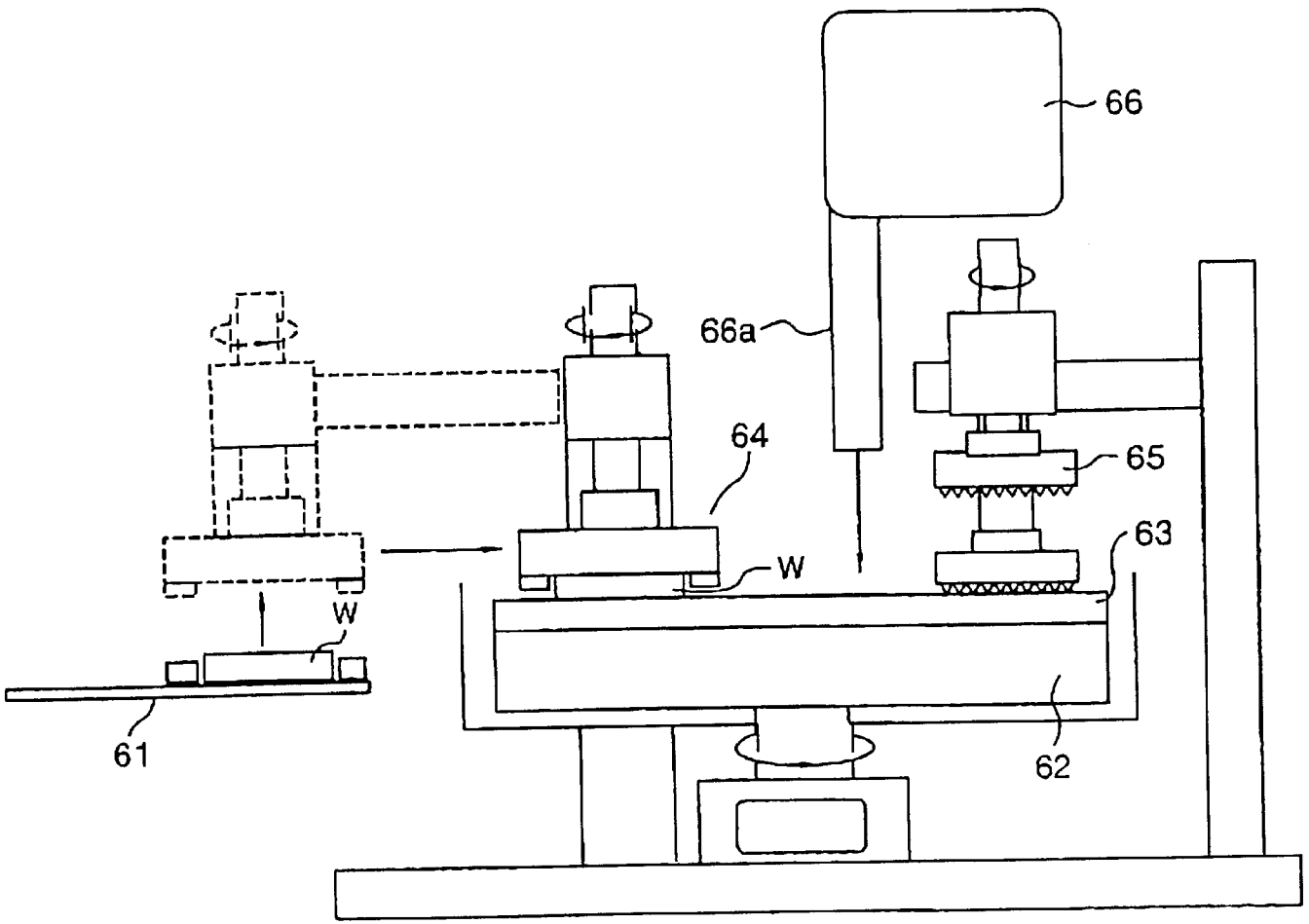
FIG. 2 PRIOR ART
FIG. 2 is a diagram for describing an example of a polishing process in a conventional polishing apparatus.

Referring to FIGS. 1A, 1B, and FIG. 2, a conventional polishing apparatus will be described at first in order to facilitate an understanding of this invention. It will be assumed that a wafer has a lead wire pattern structure. In FIG. 1A, a lead wire groove 51 is formed in a surface-flattened interlayer dielectric film on a silicon substrate 50. A metal film 52 grows so that the metal film 52 fill the lead groove in order to form the lead wire pattern structure. In FIG. 1B, the metal film 52 is selectively removed by chemical-mechanical polishing (CMP) method. As a result, a lead line 53 is formed which is selectively embedded a metal in the lead groove 51. The conventional polishing apparatus may be called a CMP apparatus. In other words, the conventional polishing apparatus polishes the metal film 52 into the lead line 53. that the metal film 52 fill the lead groove in order to form the lead wire pattern structure. In FIG. 1B, the metal film 52 is selectively removed by chemical-mechanical polishing (CMP) method. As a result, a lead line 53 is formed which is selectively embedded a metal in the lead groove 51. The conventional polishing apparatus may be called a CMP apparatus. In other words, the conventional polishing apparatus polishes the metal film 52 into the lead line 53.

Referring to FIG. 2, the CMP apparatus comprises a rotatable large-diameter polishing table 62, a rotatable wafer holding head 64, a polishing pad conditioner 65, and a supply section 66. To the CMP apparatus, a wafer transfer system 61 transports a semiconductor wafer W having semiconductor device patterns in order to polish the semiconductor wafer W. The wafer transfer system 61 transports the polished wafer out of the CMP apparatus. The polishing table 62 has a polishing pad 63 stretched on the polishing table 62. The polishing table 62 has a diameter twice greater than that of the wafer W. The polishing pad 63 is made of, for example, a polyurethane sheet. The wafer holding head 64 receives the wafer W from the wafer transfer system 61 to press the wafer onto the polish pad 63. The polishing pad conditioner 65 is for refreshing the polishing pad 63. More particularly, the polishing pad conditioner 65 has a rotatable disk (not shown) on which fine diamond particles of 100 to 500 micrometers are electrolytically deposited. By the rotatable disk, the surface of the polishing pad 63 is recovered. The supply section 66 is for supplying a slurry (abrasive fluid) with silica particles dispersed in a pure water.

In the CMP apparatus, the polishing pad 63 is directed upwardly of FIG. 2. The polishing surface of the wafer W is directed downwardly of FIG. 2. A few drops of polishing slurry are directly introduced onto the polishing pad 63 from the pipe 66*a*. Slurry exists in the state of a liquid film on the upper-surface of the polishing pad 63. The polishing pad conditioner 65 is driven downwardly of FIG. 2 to be in contact with the polishing pad 63 in order to refresh the polishing pad 63. The CMP apparatus describe in conjunction with FIG. 2 has problems which have been described in "Background of the Invention."

Figure 3:
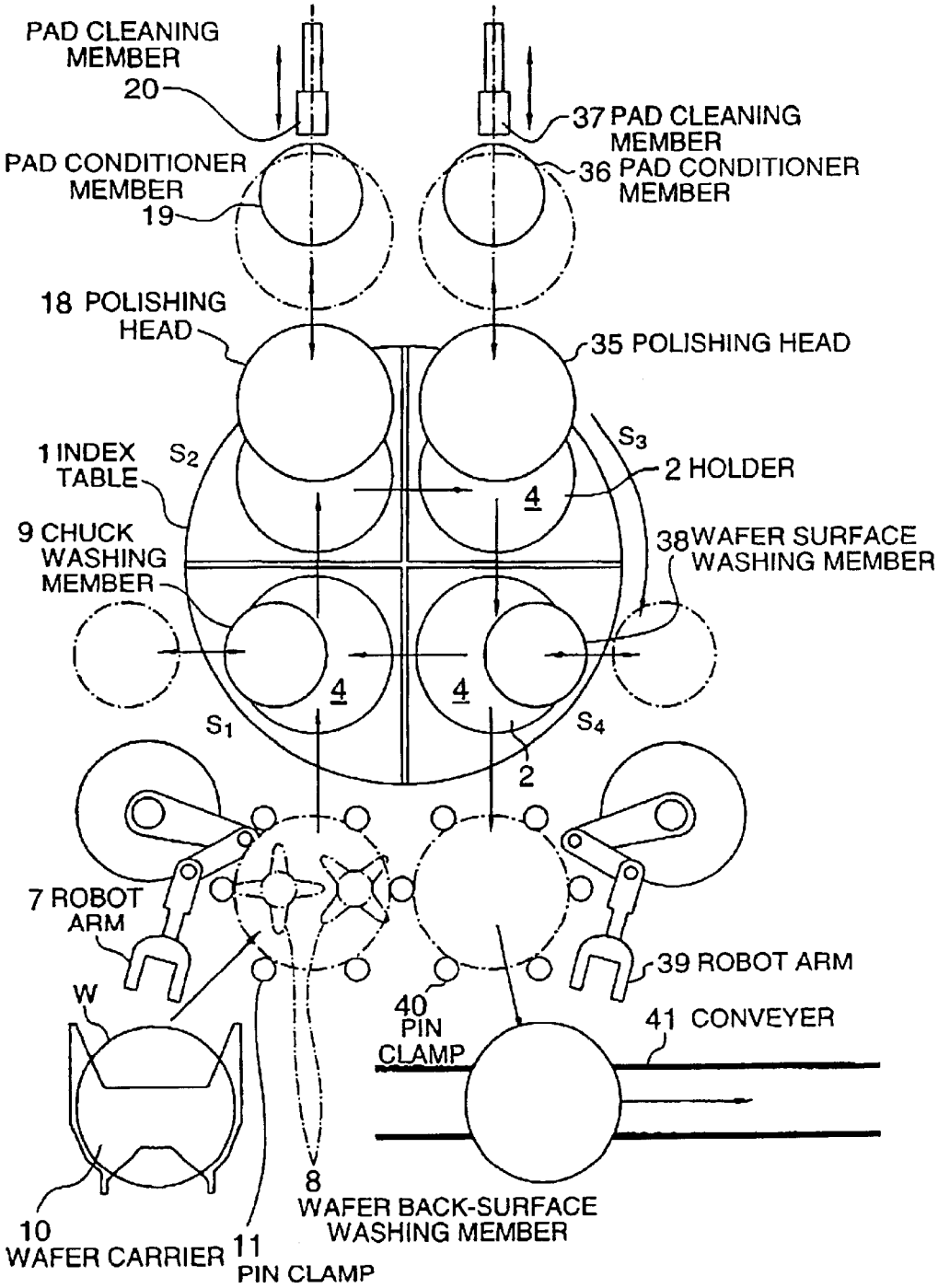
FIG. 3 schematically shows a plan view of an automatic polishing apparatus according to a preferred embodiment of this invention.
Figure 4:
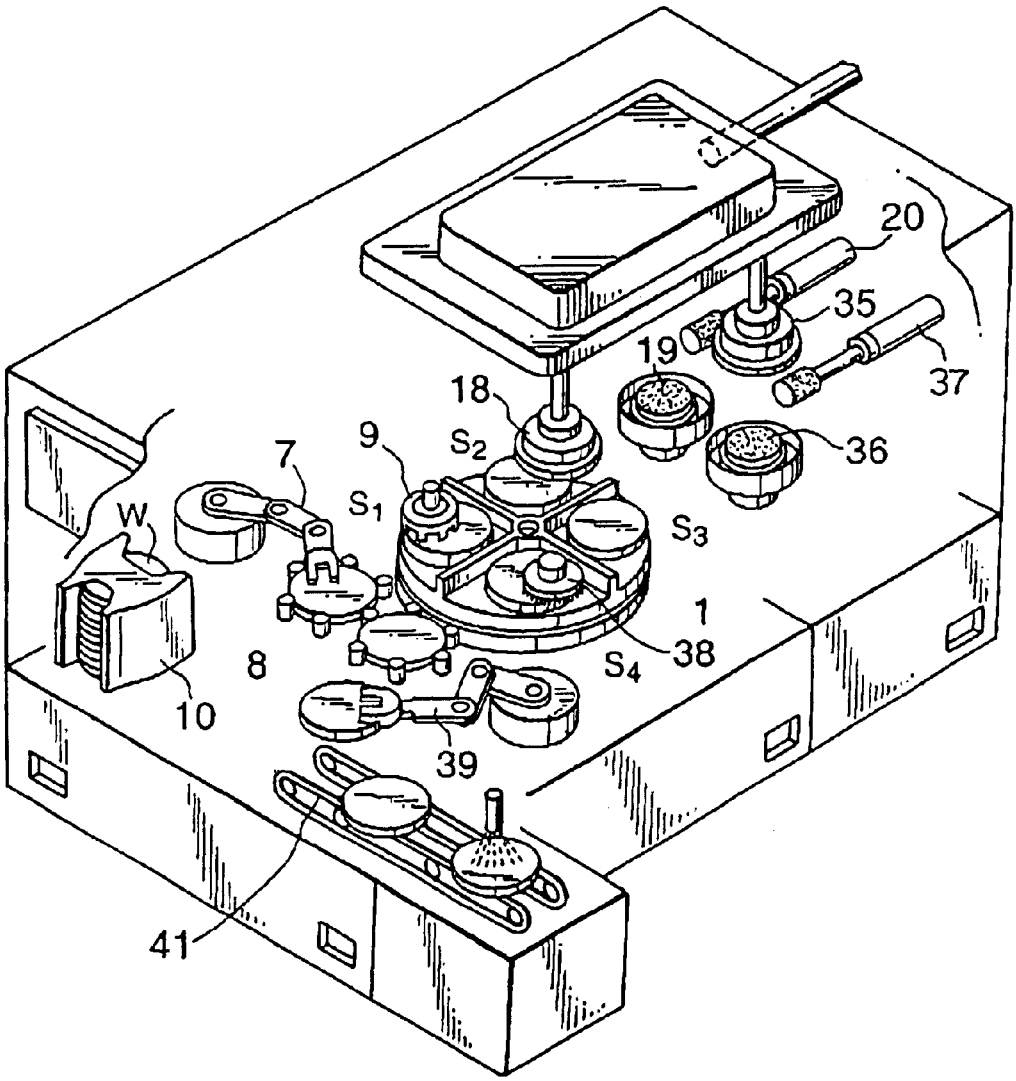
FIG. 4 shows a view of a practicing form of automatic polishing apparatus illustrated in FIG. 3.

Referring to FIGS. 3 and 4, description will proceed to an automatic polishing apparatus according to a preferred embodiment of this invention.

The automatic polishing apparatus comprises an index table 1, a loading station S1, a primary polishing station S2, a secondary polishing station S3, and an unloading station S4. The loading station S1, the primary polishing station S2, the secondary polishing station S3, and the unloading station S4 are set up along the circumference of the index table 1. The index table 1 has a plurality of holders 2 which are disposed along a concentric circle. Each of the holders 2 supports a wafer thereon. The stations S1 to S4 are sequentially given a rotational feed. The stations S1 to S4 are assigned at stop positions of the index table 1. More particularly, the polishing stations are positioned at stop positions each of which may be called a first stop station. The loading station is positioned at a second stop position of the index table 1. The unloading stations is positioned at a third stop position of the index table 1.

The loading station S1 is a region for use in transferring the wafer onto the index table 1. The unloading station S4 is a region for use in transferring the polished wafer from the index table 1. The primary polishing station S2 is a region for use in planarizing the surface of the wafer which is transferred onto the index table 1. The secondary polishing station S3 is a region for for use in carrying out a final process to the planarized wafer. By partition walls 1*a*, the upper surface of the index table 1 is divided into four blocks at predefined angular distances of 90 degree. The holders 2 are positioned at the blocks, respectively.

Figure 5:
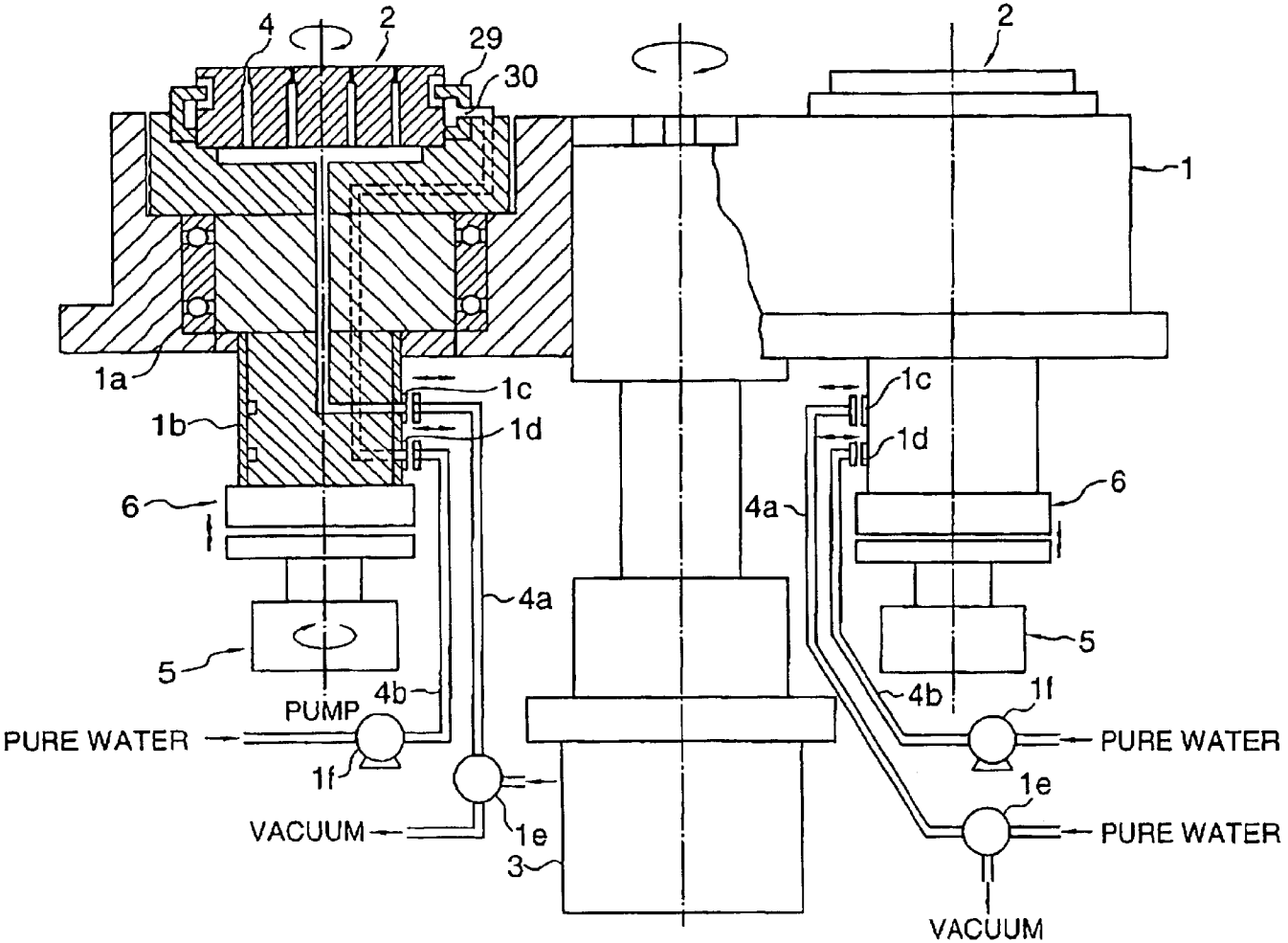
FIG. 5 shows a cross-sectional view of an index table illustrated in FIG. 3.

Referring to FIG. 5, the index table 1 is driven by a stepping motor 3 to rotate in essentially uniform angular movement of 90 degree, in order to sequentially transfer the holders 2 to the stations assigned at the stop positions of the index table 1. Each of the holders 2 is for supporting a wafer thereon. In the example being illustrated, each of the holders has a vacuum chuck 4 positioned on an upper surface. The vacuum chuck 4 is for holding the wafer by a suction force. Each of the stations S1 to S4 has a motor 5 for driving its associated holder 2. Each holder 2 is supported through a bearing 1*a* on the index table 1. Each holder 2 has an electromagnetic clutch 6 which is selectively connected to the motor 5. When each holder 5 is connected to the motor 5 by the electromagnetic clutch 6, each holder 2 rotates in an uni-direction at the rotation speed of the motor 5.

A sleeve 1*b* is attached to the holder 2. The sleeve 1*b* is integrated with the the index table 1. An evacuation path of the vacuum chuck 4 is formed in the holder 2 to have an annular opening in the drum section of holder 2. The annular opening is sealed by the sleeve 1*b* and mates with an external pipe 4*a* at a port 1*c* of the sleeve 1*b*. The pipe 4*a* communicates with a vacuum pump (not shown) and is provided with a switch valve 1*e*. The port 1*c* has a electromagnetic chuck (not shown). The electromagnetic chuck is put in operation when the holder 2 arrives at the polishing station S2 or S3. By the electromagnetic chuck 4, the external pipe 4*a* communicates with the vacuum chuck 4. By the vacuum pump, an air is exhausted or from the vacuum chuck 4 through the external pipe 4*a*. The port 1*c* is closed during rotational movement of the index table 1. The evacuation path of the vacuum chuck 4 on the side of holder 2 is separated from the external pipe 4*a*. As will be described later, the switch valve 1*e* is coupled to a wash liquid supply pipe. The wash liquid is supplied to the the vacuum chuck 4 to be reversely injected when the vacuum chuck 4 is subject to a washing process.

Pure water is supplied to the vacuum chuck 4 from a seal ring 29 on the outer circumference thereof. A pure water supply path is formed in the holder 2. The pure water is pumped up by a pump if to the external pipe 4*b*. The pure water is supplied to the pure water supplying path from the external pipe 4*b* through a port 1*d* of the sleeve 1*b*. The port id has an electromagnetic clutch. The electromagnetic clutch of the port 1*d* is put in operation only when the holder 2 arrives at the station S2 or S3. The electromagnetic clutch of the port 1*d* makes the external pipe 4*b* communicates with the pure water supply path in the holder 2.

Referring to FIGS. 3 and 4; description will proceed to the loading station S1. The loading station S1 is equipped with a robot arm 7, a wafer back-surface washing member 8, and a chuck washing member 9. The robot arm 7 takes wafers W out of a wafer carrier 10 in a one-by-one manner to transfer the wafer W to a location under a pin clamp 11. The pin clamp 11 is for use in transferring the wafer W onto the index table 1 after wafer back-surface washing process. The pin clamp 11 has several pins which are shrinkably and expandably disposed at selected positions aligned along the same circumference. The wafer back-surface washing member 8 is for Use in washing the back surface of the wafer W held by the pin clamp 11. The wafer-back-surface washing member 8 may be, for example, brushes.

Figure 6:
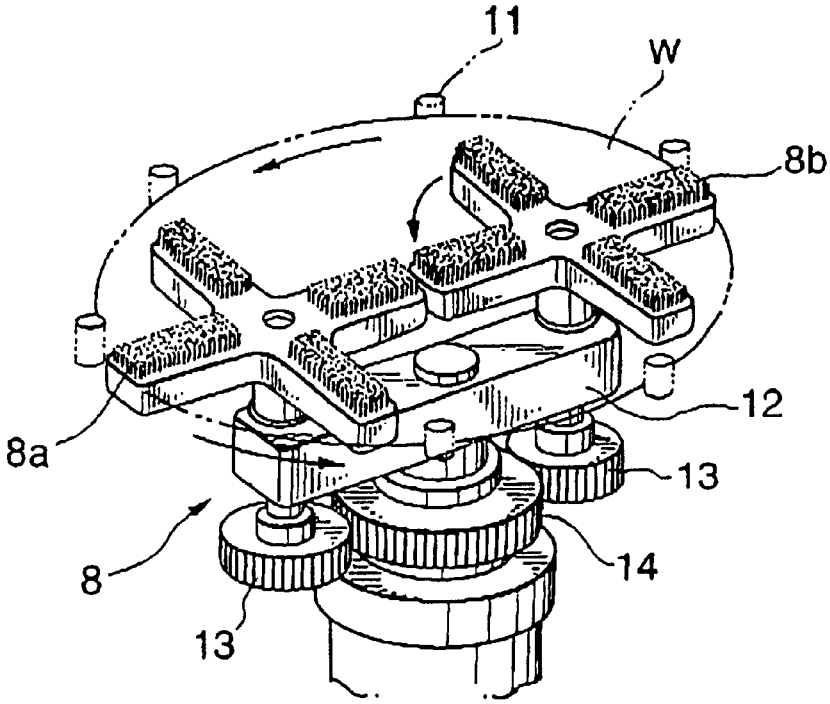
FIG. 6 shows a view of a wafer back-surface washing section illustrated in FIG. 3.

Referring to FIG. 6, a pair of brushes 8*a* and 8*b* are attached to the opposite ends of a brush holder 12. The brushes 8*a* and 8*b* face upwardly. A planetary gear 13 is mounted at a brush shaft of each brush. The planetary gear 13 is engaged with a central gear 14. The brush holder 12 is rotated by the center gear 14 so that the brushes 8*a* and 8*b* carry out revolution with rotation. The brushes 8*a* and 8*b* are pushed onto the back surface of the wafer W held on the pin clamp 11. The brushes 8*a* and 8*b* are rotated to remove contaminants on the wafer back surface while supplying wash water to the wafer back surface.

The chuck washing member 9 is for use in washing the vacuum chuck 4 of the holder 2 that holds the wafer by the suction force. Prior to transport of the wafer W, the chuck wash member 9 is advanced onto the holder 2 and is moved downwardly onto onto the holder 2 to clean a suction surface of the vacuum chuck 4.

Figure 7:
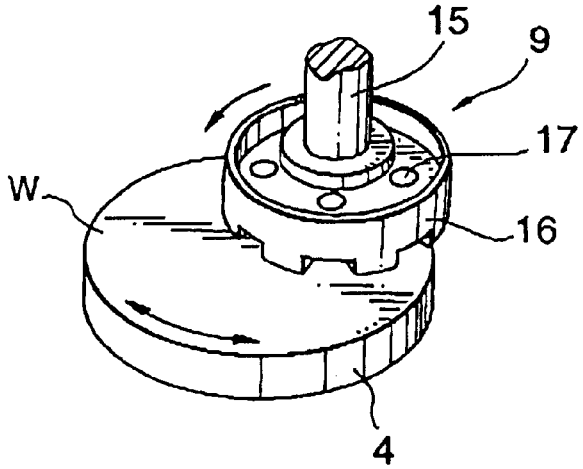
FIG. 7 shows a view of a chuck washing section illustrated in FIG. 3.

Referring to FIG. 7, the chuck wash member 9 has a round disk-shaped chuck washing section 16 disposed at the shaft end of a rotation shaft 15. The chuck washing section 16 is a circular ceramic ring with a web surface on which wash-water supply holes 17 are formed. The chuck washer section 16 is rotated while wash water is supplied to the chuck wash section 16 through the supply holes 17. The chuck washer section 16 is pressed onto the suction surface of the vacuum chuck 16 to wash the suction surface of vacuum chuck 4. By this washing process, a sludge is broken and is washed away when the sludge exists on the support surface of the chuck 4, in order to prevent the wafer W from generation of dimples.

After washing the suction surface of the vacuum chuck 4 along with the back surface of the wafer W, the wafer W held on the pin clamp 11 is transferred onto the holder 2 of the loading station S1, in order to absorb the wafer W on the suction surface of the vacuum chuck 4. After introduction of the wafer W, the index table 1 is rotated by a fixed rotation angle (90 degree) to transfer the wafer W to the primary polishing station S2. The holder 2 moved into the loading station S1 waits for transport of a new wafer.

Figure 8:
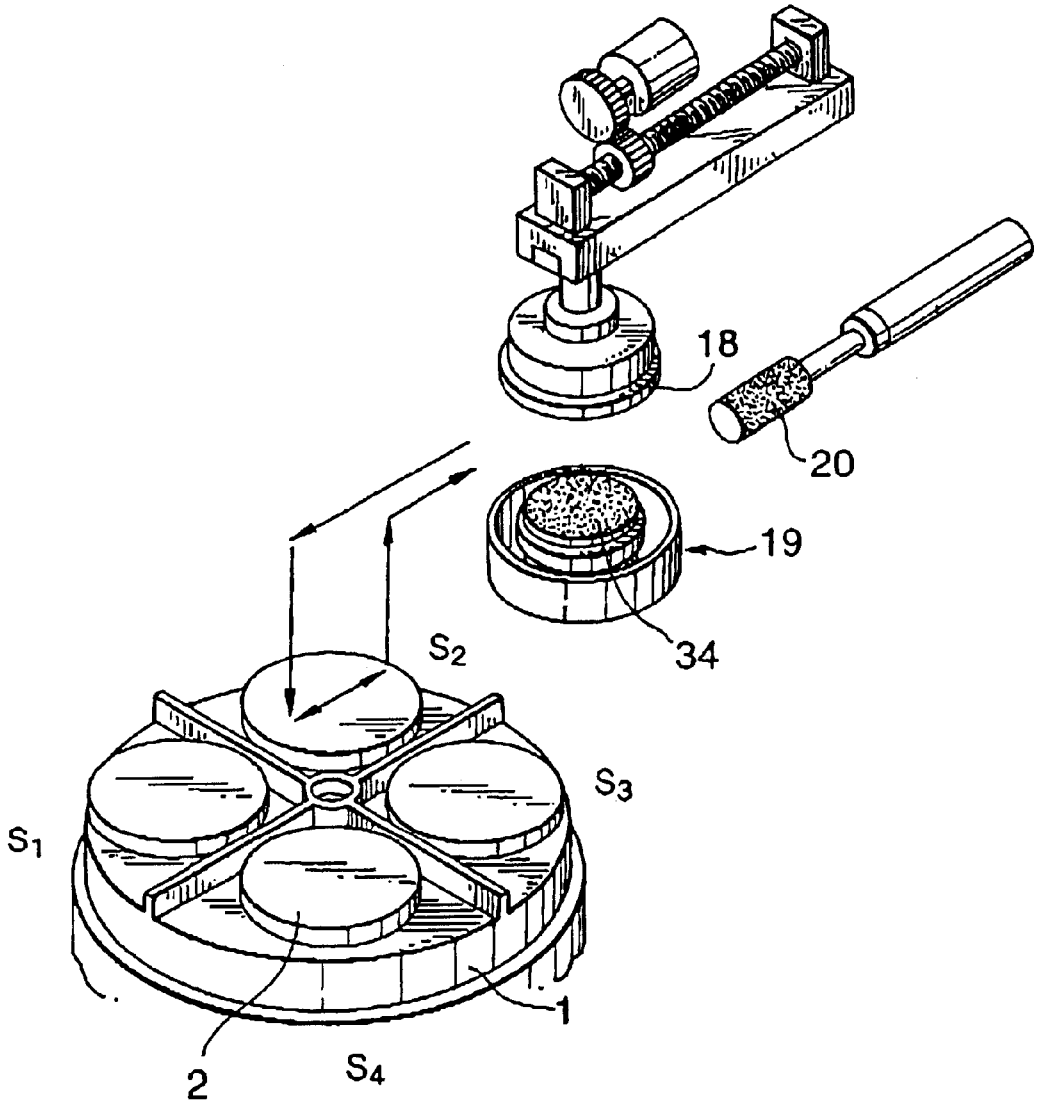
FIG. 8 shows a view of a primary polishing station illustrated in FIG. 3.
Figure 9:
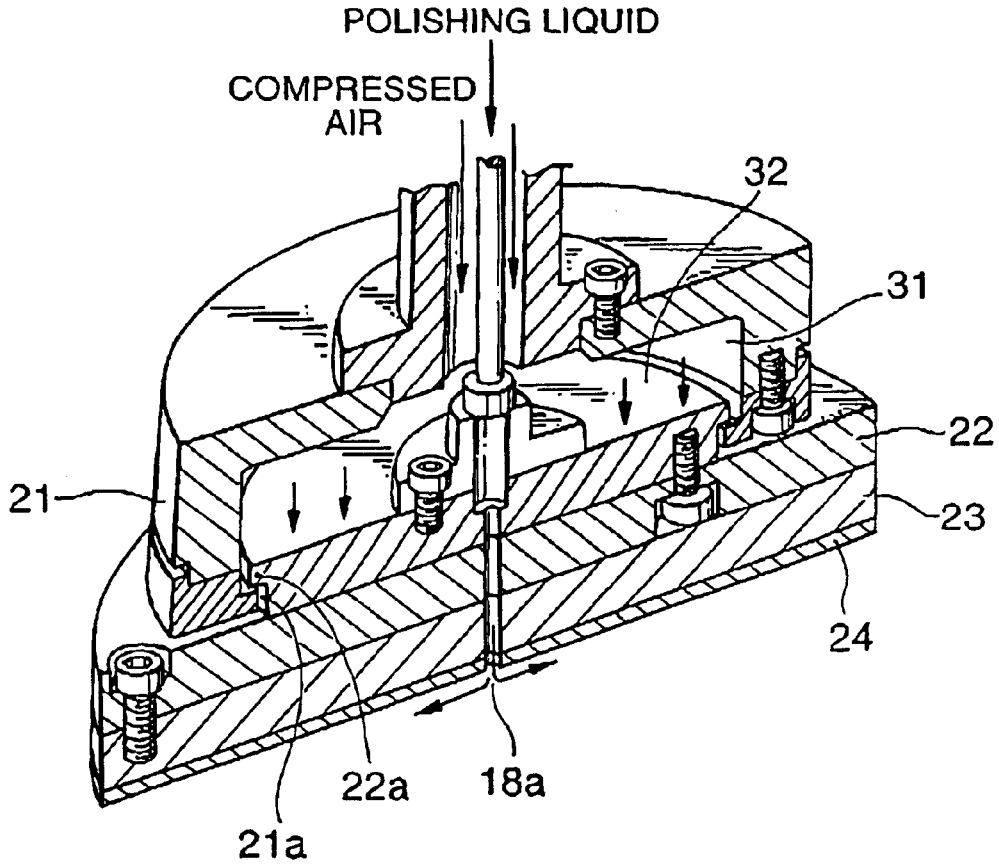
FIG. 9 shows a view of a polishing head illustrated in FIG. 3.

Referring to FIG. 8, the primary polishing station S2 is equipped with a polishing head 18, a pad conditioner 19, and a pad cleaning member 20. As shown in FIG. 9, the polishing head 18 consists of an assembly of a pressure cylinder 21, a base plate 22, and a polishing cloth-pasted plate 23. The polishing head 18 has a hard polishing cloth 8*a* on the polishing surface. The polishing head 18 is downwardly hanged with a spindle 25 supporting the pressure cylinder 21. The polishing head 18 goes down from a refuge position onto the vacuum chuck 4 of the primary polishing station S2 to fall onto the wafer W presently sucked on the vacuum chuck 4. The polishing head 18 presses the polishing cloth 24 to the surface of the wafer W in order to carry out planarization process by rough polishing. On a rough polishing process, the holder 2 supporting the wafer W is rotated at a high speed. The polishing head 18 is rotated in one direction. In this event, the abrasive fluid (slurry) is supplied to the polishing cloth 2 through the liquid-feed hole 18*a* placed at the center of the rotation. The abrasive fluid is forced to uniformly expand or disperse along the outer periphery of the polishing cloth 24. Therefore it is possible to rotate the holder 2 at the high-speed rotation of the holder 2.

Figure 10:
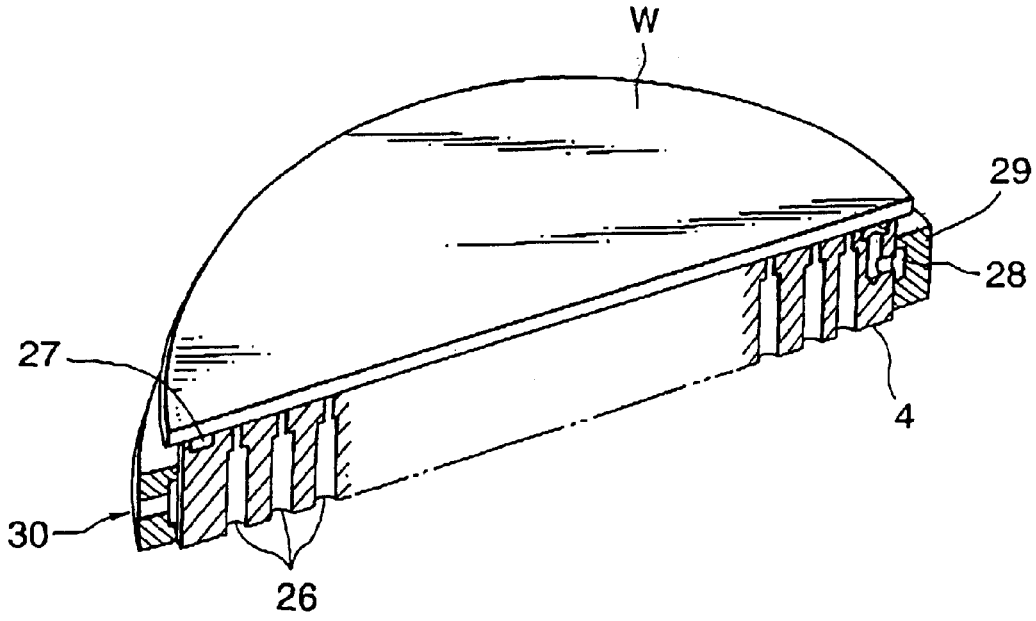
FIG. 10 shows view of a structure of a vacuum chuck illustrated in FIG. 3.

The wafer W is clamped to suction holes 26 of the vacuum chuck 4 as shown in FIG. 10. At a location outside the opening region of such suction holes 26, the vacuum chuck 4 has a water seal room 27 resembling an annular groove which is opened at the upper surface. The water seal room 27 communicates with a water-flow groove 28 which is opened at the side wall of the vacuum chuck 4. The water-flow groove 28 is in turn coupled to a water supply hole 30 opened at the inner wall of the seal ring 29. The wash water is injected to the water supply hole 30 in order to make the wash water overflow from the water seal room 27. Such arrangement may prevent the abrasive fluid from escaping onto the lower surface of wafer w to harden and staying on the wafer support surface during polishing. Simultaneously, penetration or immersion of the abrasive fluid into the suction holes 26 of the vacuum chuck 4 is eliminated.

Referring to FIG. 9, an overhung edge 22*a* of a base plate 22 is supported at a flange section 21*a* of the pressure cylinder 21 in the polishing head 18. The polishing cloth 24 is held at the base plate 22 via the polishing a cloth-pasted plate 23. A diaphragm 32 is stretched over within a pressurizing chamber 31 inside the pressure cylinder 21. A high-pressure air is introduced into a pressure chamber 31 through the spindle 25 The base plate 22 is swingably supported by such a pressure in three-dimensional directions so that the polishing cloth 24 at the lower surface is forced to maintain a parallel attitude with respect to the surface of the wafer W.

Figure 11:
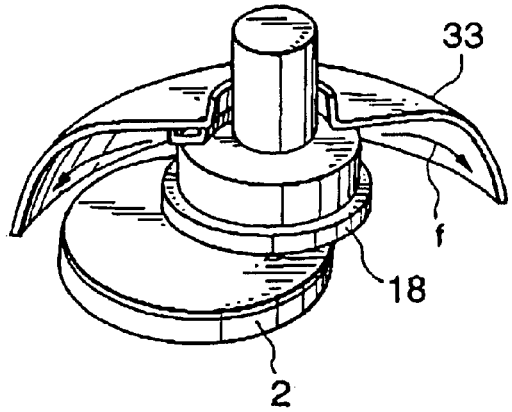
FIG. 11 shows a view of a hood for covering the polishing head.

The polishing head reciprocally moves on rails laid on the index table as a guide. It should be required that the rails be perfectly parallel to the wafer surface in case the polishing head is made of the perfect rigid material. If such parallelism is destroyed, the polishing pressure can vary with a feed of polishing head, which might result In nonuniformity of polishing over the wafer surface. In the above-mentioned embodiment, a structural extra-margin or idleness is provided by a specific mechanism for enabling the polishing cloth surface to swing in fine movements due to application of a pressure on the polishing cloth using highly pressurized air. The rotation torque is transmitted from the pressure cylinder 21 to the base plate 22. As shown in FIG. 11, the polishing head 18 is closed by a hood 33 therearound during wafer polishing. After completion of such process, the wash water f continuously flows along the inner surface of the hood 33. As a result, it is possible to prevent dry of splashed abrasive fluid and elimination of accidental breakage of the wafer W due to drop-down of solid material in the abrasive.

In FIG. 8, clog and/or fiber-state nonuniformity occur in the polishing cloth 24 of the polishing head 18 on polishing the wafer W. Such clogging and/or fiber-state nonuniformity may be corrected by the pad conditioner member 19. The pad conditioner member 19 has a rotatable pad conditioning disk 34. On carrying out a fiber recovery (dress-up), the rotatable pad conditioning disk 34 is pressed to the polishing cloth 24 (see FIG. 9) of the polishing head 18 and rotated.

On carrying out the fiber recovery of the polishing cloth 24, the high-pressure air is further introduced into the pressure cylinder 21 in FIG. 9. When the overhung edge 22*a* of the base plate 22 is attached to the flange section 21*a* of the pressure cylinder 21 by a pressure greater than a polishing pressure, the base plate 22 having the polishing-cloth 24 is fixed to the pressure cylinder 21 to render the polishing cloth 24 stable. After completion of the fiber recovery of the polishing cloth 24, the brushes acting as the pad cleaning member 20 are driven forward and backward with rotation to remove any dropped abrasive particles and abrasive powders residing on the surface of the polishing cloth 24 After getting ready for a next rough wafer polishing, the index table 1 is rotated by a predetermined angle (90 degree). The primary (rough) polished/planarization-completed wafer W transfers to the secondary polishing station S3.

Referring to FIGS. 3 and 4, the secondary polishing process in the secondary polishing station S3 is carried out for purposes of further reduction of the surface roughness of the surface of resultant wafer obtained by the primary polishing process. In the secondary polishing process, an abrasive fluid is different from that used in the primary polishing process. In the secondary polishing process, the abrasive fluid is suitable for final or finish polishing. The secondary polishing station S3 is similar in structure to the primary polishing station S2. The secondary polishing station S3 has a pad conditioner member 36 and a pad cleaning member 37 in addition to a polishing head 35. An operation in the secondary polishing process is similar to the that of the primary polishing process except that the wafer W transferred to the secondary polishing station S3 is subject to surface finishing treatment by the polishing head 35.

The polishing cloth of the polishing head 35 mounted in the secondary polishing station S3 is soft as compared to the hardness of the polishing cloth of the polishing head 18 used in the primary polishing station S2. In the finishing polish station S3, the secondary polishing process is done in a time longer than that of the primary planarization process. Once the secondary polishing process is completed, the index table 1 rotates by the predetermined angle so that the wafer W is transferred to the unloading station S4.

Again referring to FIGS. 3 and 4, the unloading station S4 is equipped with a wafer surface washing member 38 and a robot arm 39. The wafer surface wash member 38 may be, for example, a brush for washing the surface of the wafer W.

Figure 12:
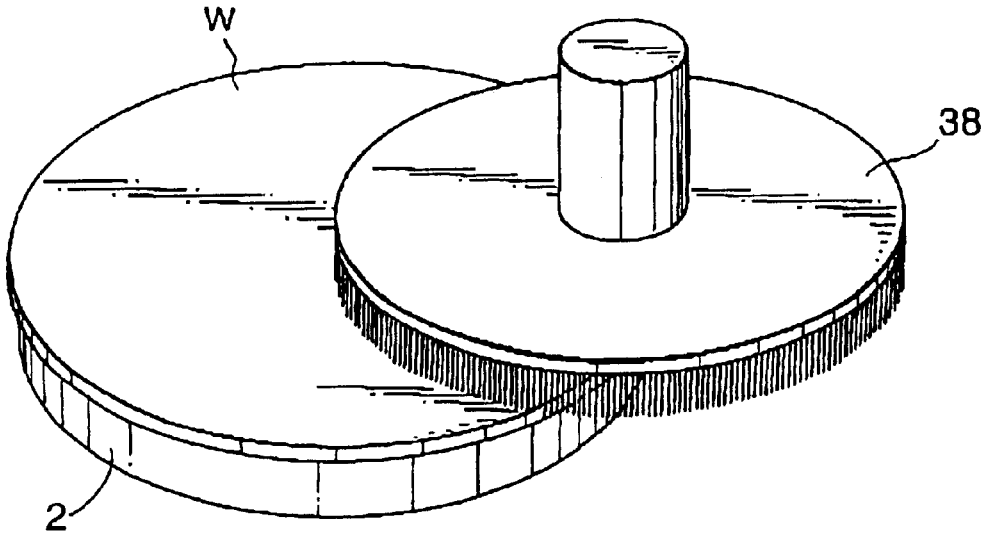
FIG. 12 shows a view of a wafer surface washing section illustrated in FIG. 3.

During washing, the holder 2 supporting the wafer W is rotated. The wafer surface washing member 38 is pressed onto the rotating wafer W to wash the wafer W. In the example being illustrated, the wafer surface washing member 38 may be a rotatable disk-shaped brush as shown in FIG. 12. On washing the wafer W, the disk-shaped brush is moved from a refuge or "wait" position above the holder 2. After washing the wafer W, water and air blows out of the vacuum chuck 4 by a reverse or back pressure to unlock the wafer from the the holder 2. The robot arm 39 shifts onto a conveyer 41 the wafer w which is taken out of the holder 2 by the pin clamp 40. The polished wafer W is transferred to a subsequent process step by the conveyer 41. The index table 1 is rotated by the predetermined angle (90 degree) to transfer the holder 2 to the loading station S1. The index table 1 gets ready for entry of a next wafer.

In the above-mentioned embodiment, the wafer held by the pin clamp is introduced to the loading station S1. The index table Is rotated in the predetermined angle (90 degree) at a time. The wafer sequentially undergo planarization process and finish treatment through the primary polishing station S2 and the secondary polishing station S3. The wafer W is delivered to the outside from the unloading station S4 while simultaneously carrying out the planarization process and the finishing treatment for another wafer on the index table 1. In the above-mentioned embodiment, a wafer W is attached to the vacuum chuck 4 of the holder 2 disposed on the index table 1. The polishing head goes down to press the wafer W, in order to carry out the planarization process along with finish processing. It is possible to always watch the polished surface of the wafer W in case where the polishing head has a diameter less than that of the wafer. It is possible to freely set up the rotating speed and polishing pressure of the holder 2 while measureing a condition of the wafer surface and a polishing thickness of the polished wafer. As a result, it is possible to carry out the polishing process with respect to the wafer W with the processing criteria optimized.

Even if certain time differences are found between the planarization process in the primary polishing station S2 and the finish process in the secondary polishing station S3, it becomes possible, by shifting the polishing start time points of the both polishing processes so as to ensure that the processing end time points are identical to each other, to shorten the time period spanning up to the washing after completion of the polishing. Furthermore, it is possible to prevent elimination of dry-hardening and attachment of abrasive fluid to wafers after polishing.

In the above-mentioned embodiment, the dimension of the suction-support plane of the holder 2 for suction support of a wafer is set less than at least the outer diameter of the wafer. Accordingly, the wafer transfer to the loading station S1 and wafer transportation from the unloading station S4 are carried out by the pin clamp. If the suction-support plane of the holder is less than the wafer outer diameter, the wafer is supported with part extended beyond the outer edge of the holder. When the wafer is transferred to the holder of the loading station and when the wafer is taken out of the unloading station, a wafer extension part is held by the pin clamp. As a result, it is easy to transfer the wafer to the holder and to take the wafer out of the holder.

Figure 13:
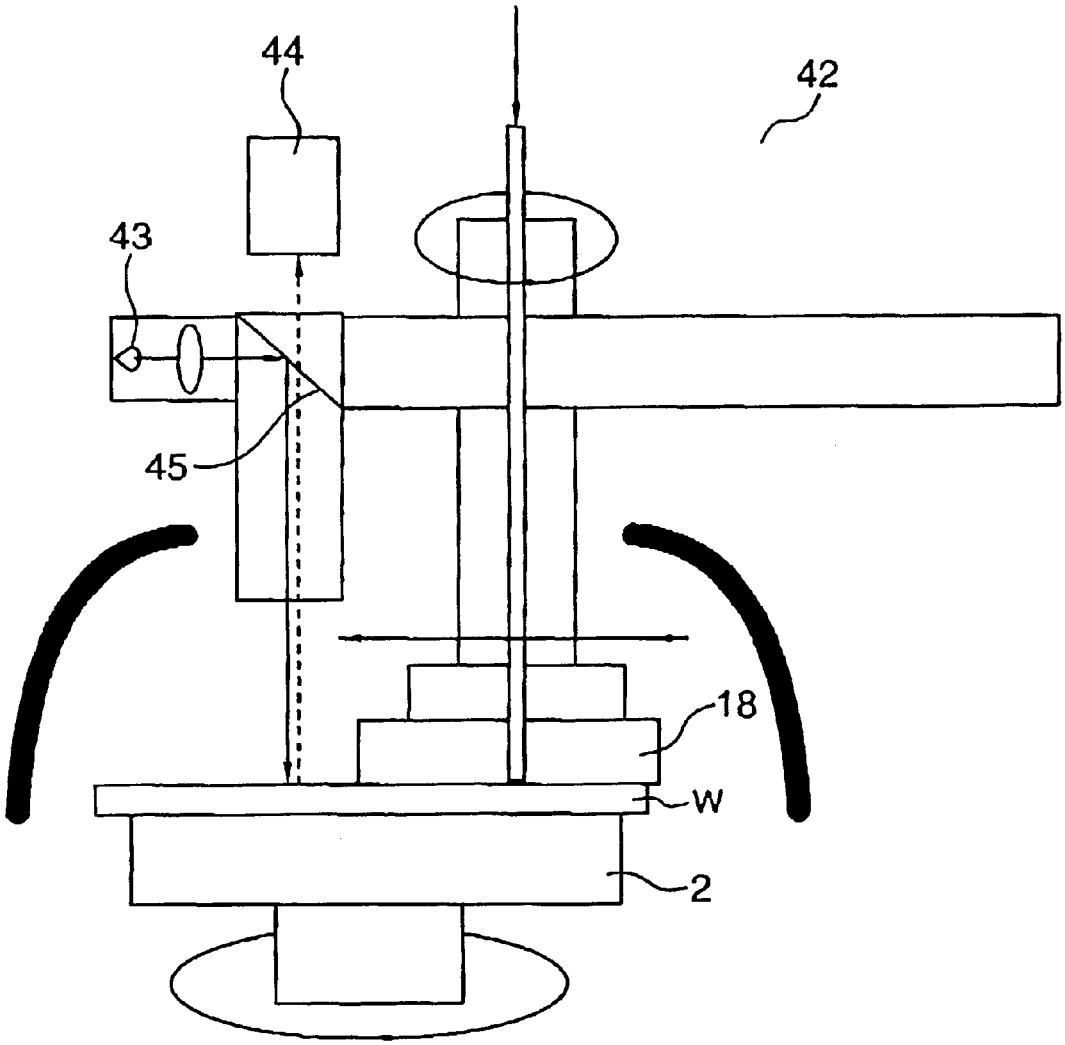
FIG. 13 shows a view of a wafer surface washing section illustrated in FIG. 3.

Referring to FIG. 13, a wafer surface detection member 42 is for detecting completion of the finish process of the wafer surface planarization processing. The wafer surface detector member 42 comprises a light source 43 and a photometer 44. Laser light of a predetermined luminous intensity is emitted from the light source 43. The laser light is optically guided to reflect off from a half mirror 45 to be vertically injected onto the surface of a wafer which has been polished. The photometer 44 is operable to continuously sense the intensity of such reflection light. When all of the metal films formed on the wafer W are removed away by polishing and when a underlying film (silicon oxide film) is exposed on the resulting surface, a change takes place from reflection of metals to reflection of the underlying film. Thus, it is possible to detect completion of the metal-film polishing process when sensing the intensity of reflection light due to such change in reflectivity on the wafer. Although the laser light vertically strikes on wafer in the above-mentioned embodiment, the laser light may strike on the wafer at optional angle. Furthermore, it is possible to know the finish polishing completion time point by measureing a change in temperature of the surface of a wafer.

Although the description is made about both of the rough polishing and finish polishing processes on the index table in the above-mentioned embodiment, the principles of the this invention should not exclusively be limited to the case of performing such rough polishing and finish polishing at separate process steps independent of each other. The stations are assigned with more than three steps for polish processes thereby permitting execution of two or more rough polishing processes or alternatively more than two finish polishing processes. This invention may be employed only for execution of at least one rough polishing process or finish-polishing process. The loading station and the unloading station may be achieved by a single module that offers both functions required. The partition of the station may be two or more. Furthermore, the index table should not be limited to the arrangement for providing rotation in uniform angular movements of 90 degree.

Figure 14:
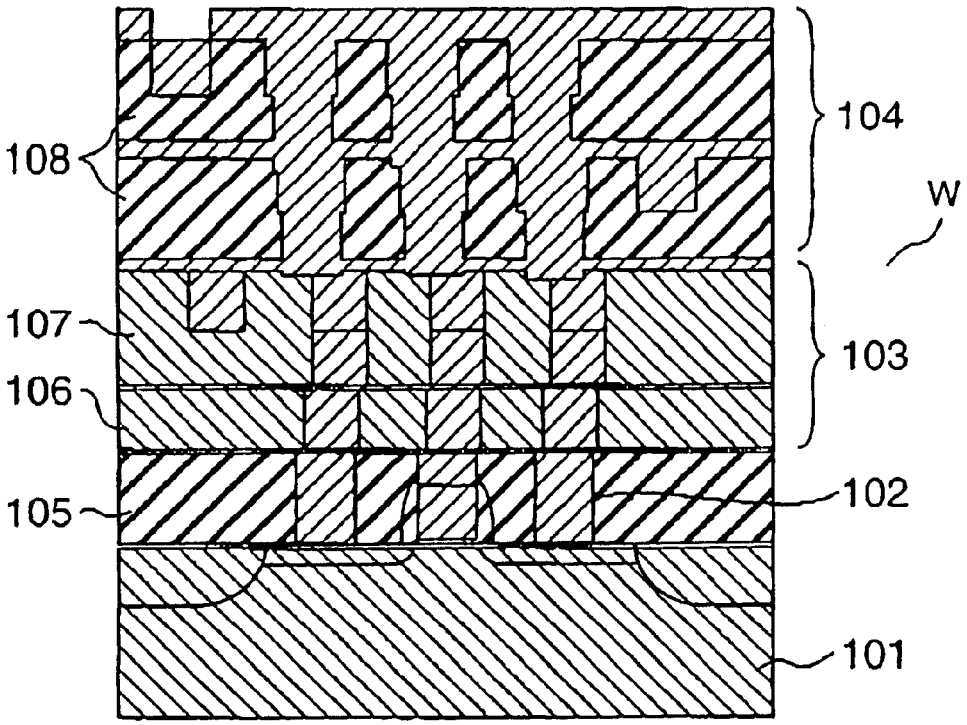
FIG. 14 shows a cross-sectional view for illustrating multilayer lead line structure on a silicon substrate.

FIG. 14 depicts a multi-layer lead-line structure on a silicon substrate 101 on which a MOSFET is formed. Referring to FIG. 14, the multi-layer lead-line structure consists essentially of a tungsten contact plug section 102 for connecting the MOSFET to an upper-layer lead, an aluminum local lead line section 103 for providing connections within a CMOS circuit block, and a copper global lead line section 104 having a low-dielectric-constant organic film with copper embedded therein. A planarized element-separation structure is employed for separation or isolation of elements between adjacent MOSPETs, which structure includes a silicon oxide film buried in a groove as formed in the silicon substrate 101 by utilizing a CMP method. Furthermore, a BPSG film 105 is grown on the MOSPET. The BPSG film 105 is also planarized by the CMP method. The surface-flattened BPSG film 105 has therein contact holes which extend to diffusion layers and gate electrode of the MOSFET. Slurry with silica particles dispersed in a water solution of oxidant is used in order to form the tungsten contact plug by use of a W-CMP method. First buried aluminum lead lineson are formed on this tungsten contact plug.

The first buried aluminum lead lines has aluminum filled in first lead grooves formed in a first silicon oxide film 106. Furthermore, second buried aluminum lead lines are formed which are made of aluminum embedded in first through-holes and a second lead groove. Each of the first through-holes and the second lead groove is formed in an overlying second silicon oxide film 107. On fabricating these buried aluminum lead lines, the buried aluminum is formed by using a high-temperature sputtering method in the lead grooves or in both such lead grooves and through-holes. The buried aluminum is subjected to planarization process by AI-CMP method employing slurry with silica particles and/or alumina particles dispersed in the water solution of oxidizer. Third buried copper lead lines are formed in second through-holes and a third lead groove. Each of the second through-holes and the third lead groove is formed in a low-dielectric-constant organic film 108 on the second silicon oxide film 107. Fourth copper lead lines have copper components buried In third through-holes and a fourth lead groove. On forming these buried copper leads, the buried copper is formed by using MOCVD method in the lead grooves or in both of the lead grooves and through-holes. The buried copper is subjected to planarization process by Cu-CMP method using slurry with silica particles and/or alumina particles dispersed in the oxidizer water solution.

As described above, multiple burying and planarization processes of metals such as W, Al, Cu, Ti, TiN, WSix, TiSix are using metal-CMP methods on forming multi-layer leads on or above the silicon substrate 101 with more than one MOSFET. The oxide-film CMP method is used to form planarized element-isolation films and to execute the surface planarization of the BPSG film surface.

Figure 15:
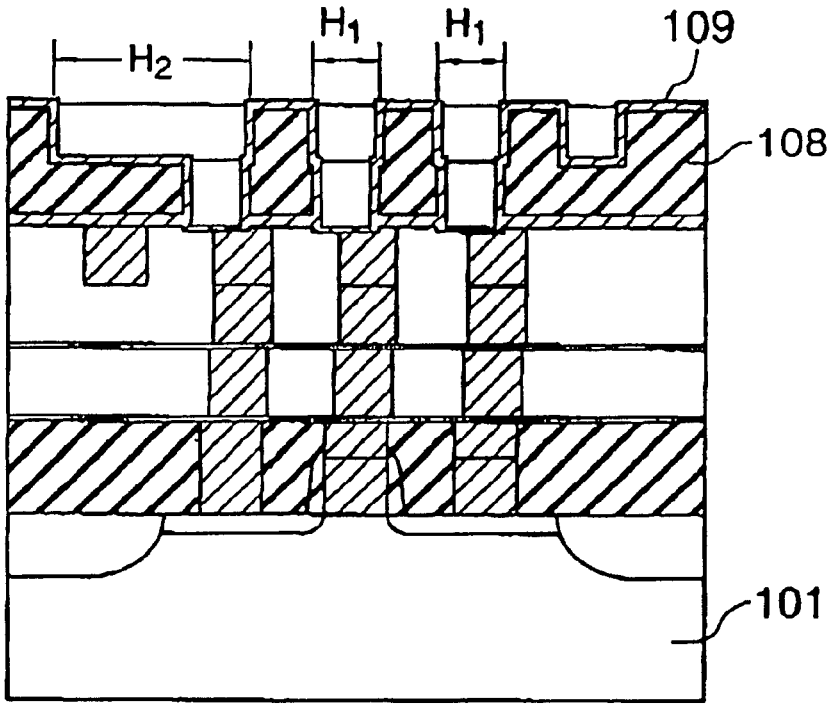
FIG. 15 shows a cross-sectional view for describing a conductive adhesion film formed by a collimate sputtering method.

Description will proceed to operation of the automatic polishing apparatus in the case of forming buried copper leads in the low-dielectric-constant organic film 108. As shown in FIG. 15, a low-dielectric-constant organic film 108 is formed along with a conductive adhesion film 109 made of TiN or Ti having a thickness of about 10 to 30 nm. The low-dielectric-constant organic film 108 is made of polyimide or benzocyclobutene having a thickness of 1 micrometer or more or less on its undercoat leads. The conductive adhesion film 109 is formed by a collimate sputtering method in each of lead grooves of 0.5-micrometer depth and through-holes of 0.5-micrometer depth extending from the back of the former to reach the undercoat lead layer.

Figure 16:
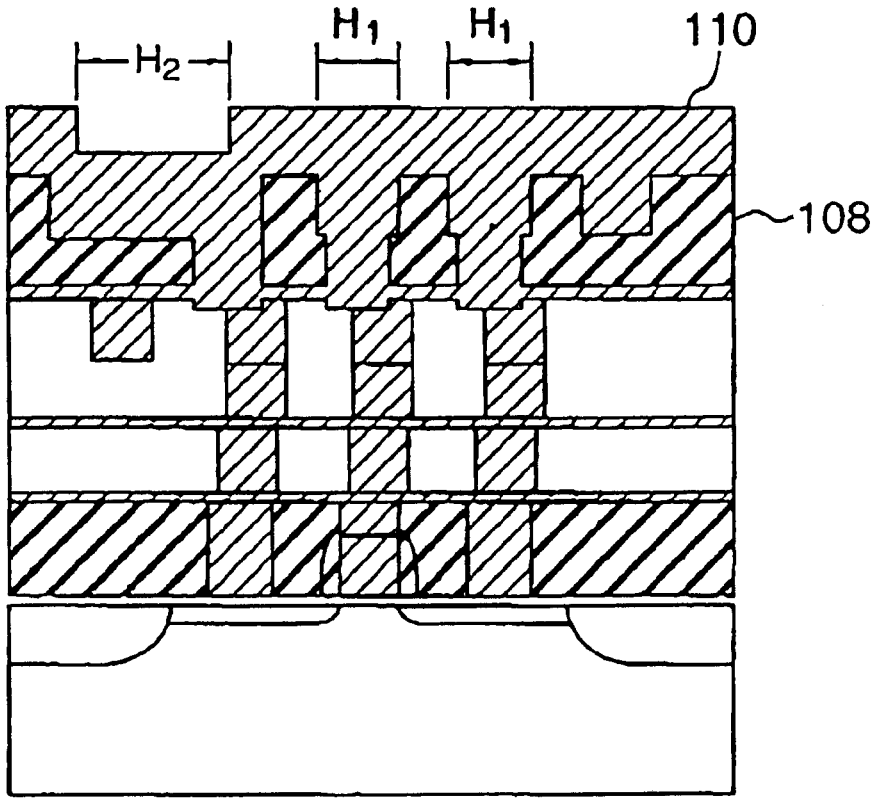
FIG. 16 shows a cross-sectional view for describing a copper film formed by MOCVD method.

As shown in FIG. 16, a copper film 110 is grown by the MOCVD method to a thickness of 0.8 micrometer at a growth substrate temperature ranging from 170 centidegree to 250 centidegree. Vacuum crystallization annealing is carried out at 250 centidegree to 400 centidegree for about 10 minutes for purposes of improvement in adhesiveness between the copper film/conductive adhesion film/low-resistivity organic film and also crystal growth of the copper film. This vacuum crystallization annealing resulted in the resistivity of the copper film 110 is reduced from 2.2 micron-ohm-centimeter down at 1.8 to 1.9 micron-ohm-centimeter. The resulting copper film 110 must come with a surface configuration corresponding to the degree of roughness of its undercoat lead film as shown in FIG. 15. More specifically, perfect lead-groove fulfillment is attained at narrow lead grooves H1 having the lead groove width equal to or less than half of the thickness of the copper film grown (0.4 micrometer) due to combination with the growth of such copper film from the sidewalls of its opposite lead grooves. In the case of a wide lead groove H2, the copper film surface is partly dimpled in profile due to the absence of such combination with copper-film growth from the sidewalls of the opposite lead grooves Such surface step-like differences can exist in the copper film surface depending upon the undercoat lead groove width.

The resultant copper film is polished by the automatic polishing apparatus according to this invention. In the loading station S1, wafers are taken out or extracted one by one from a wafer carrier, which holds therein about twenty four 8-inch silicon wafers with the growth plane of each copper film 110 facing upward. The extracted wafer is transferred to a location beneath the pin clamp. The extracted wafer is held by the pin clamp at the periphery of the extracted wafer. The back surface of the extracted wafer is washed by the wafer back-surface washing brushes. During the wafer back-surface washing, the chuck washer member washes the suction surface of the vacuum chuck composed of porous alumina. At the chuck washer member, any sludge on the suction surface is removed away to provide flatness of the suction surface. While wash liquid is fed from the chuck washer member during the vacuum chuck washing process, counter washing from the vacuum chuck to the suction surface is done. As a result, it is possible to remove solid-state particles (sludge) such as abradant separated and attached onto the fine-hole walls of porous alumina.

It is very important to completely remove away such solid-state fine particles by execution of the wafer back-surface washing and the vacuum chuck surface washing. More specifically, the surface of the sucked wafer is locally deformed to have a projection when solid-state contaminants are present between the wafer and the vacuum chuck. When such deformed wafer is polished for planarization, the local surface projection are flattened to be polished into unwanted dimples (local depressions) upon unlocking of the wafer from the vacuum chuck. This is the reason why the perfect removal of any fine particles is important. In the example being illustrated, a time duration taken for washing the back surface of a wafer along with the suction surface of the vacuum chuck may range from 30 to 60 seconds. There is no specific limitation to the washing time duration. As Regards the wash liquid, either pure water or electrolytic ion water with pure water electrolyzed is employable. No limitation is applied to the practical choice of such wash-water species. For example, a water-soluble organic polymer-dispersed water solution such as cellulose may be used together with pure water for achievement of hydrophilic process while causing an organic polymer molecule layer to be adsorbed in the wafer back surface. This substrate back-surface hydrophilic process may offer the capability to eliminate dried adhesion of sludge. Still alternatively, it is possible to use alcohol, methylethylketone, or organic amine.

After completion of the wafer back-surface washing and the washing of the suction surface of the vacuum chuck, the wafer on the pin clamp is transferred onto the holder of the loading station S1. The wafer is sucked on the suction surface of the vacuum chuck with the copper-film formation surface facing upwardly. After the wafer transport, the index table is rotated by an angle (90 degree) so that the transported wafer is moved into the primary polishing station S2. The polishing head presses the polishing cloth on the copper-film formation surface of the wafer under a pressure of about 0.01 to 0.4 kg/$cm_2$ to perform planarization process.

During the rough polishing at the primary polishing step, the holder supporting the wafer is rotates at a speed of approximately 50 to 300 rpm. The polishing head rotating at 50 to 1000 rpm is reciprocated over the wafer at a speed of 0.1 to 5 cm/second. The above operation is done while supplying abrasive fluid (slurry) from the center of the polishing cloth to the upper surface of the wafer. At that time, it is not always required that the reciprocation speed be kept at constant. It may be possible to make reciprocation speed be variable in order that the polishing cloth stays long at a central part of the wafer. The diameter of the polishing cloth is the same as or less than the diameter of the wafer. If the diameter of the polishing cloth becomes very small, the contact area between the polishing cloth and wafer decreases. As a result, the circumferential speed of polishing cloth likewise decreases. This results in a remarkable decrease in copper-film polishing speed, which leads to the lack of practicability. For the reason, it is desirable that the diameter of the polishing cloth is equal to or less than half of the radius of wafer. The polishing cloth is a cloth having a polymer sheet made of foam-urethane or polypropylene or the like with one or more grooves formed therein. The groove or grooves formed in the polishing cloth may be formed in a spiral or radial pattern from the center of abrasive fluid whereat the liquid-supply hole 18*a* exists. Therefore, it is possible to efficiently feed the abrasive fluid from the center of polishing cloth to the outer periphery thereof. While there are no specific limit as to the cross-sectional shape of such groove, a V-shaped profile may be preferable. It is more preferable that the groove edges are rounded.

The abrasive fluid for the copper film is a water solution of oxidizer that contains therein silica particles as dispersed at about 10 to 20 wt %. The abrasive fluid is caused to exhibit weak alkalinity due to addition of a minute amount of ammonia. Optionally, there may also be used an acidic abrasive fluid with a few drops of dopant mixed therein, which may Include $HNO_3$, phosphoric acid, citric acid, acetic acid or oxalic acid. The oxidizer may be hydrogen peroxide water or potassium iodide water although there are no specific limitation. Alternatively, as the abradant, alumina particles or manganese dioxide particles or cerium oxide particles may be used. In the automatic polishing apparatus according to this invention, the abrasive-liquid supply pipe inner wall and the abrasive-liquid waste exhaust pipe inner wall are pre-applied with acidic/alkali process such as Teflon-coating or the like.

Furthermore, a respective one of the stations S1–S4 is partitioned by acrylic barrier walls or the like. In at least the stations S2 and S3, local gas exhaust is done. Each of the stations S2 and S3 has a structure for eliminating generation of residual vapor of the acidic or alkali abrasive fluid. The polishing head is enclosed by the hood during polishing. During wafer polishing process and after completion of such a process, wash water is continuously flown onto the inner wall of the hood in order to prevent unwanted hardening of splashed abrasive fluid along with vaporization of liquid components of the abrasive fluid. The wash water may typically be pure water. Optionally, the abrasive fluid may also be flown onto the hood inner wall. When the wash water fed from the water seal room is supplied from the outside of the vacuum chuck, any undesirable immersion or "invasion" of the abrasive fluid to the wafer back surface is eliminated during polishing.

Figure 17:
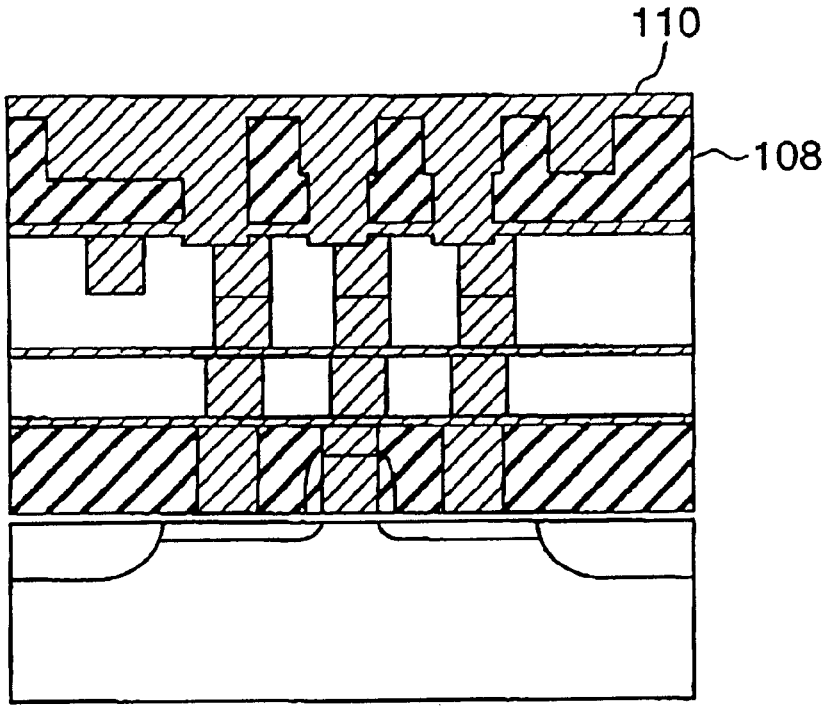
FIG. 17 shows a cross-sectional view for describing a copper film polished in a primary polishing process.

After performing the above polishing process in the primary polishing station, the surface step-like differences of the copper film 110 disappear as shown in FIG. 17. As an example, surface planarization is done by polishing a copper film, which has been grown on a low-dielectric-constant organic film from the thickness of 0.8 micrometer to the thickness of 0.2 micrometer. After the polishing was completed in the primary polishing station for a specified time duration, the pressure of the polishing head is first set in the condition of no load application. The abrasive fluid as presently supplied from the center section of the polishing cloth is replaced with pure water to thereby rapidly remove the abrasive fluid out of the upper surface of the copper film.

This pure water supply process is important because the abrasive fluid has also the chemical capability to etch copper. In view of the fact that the pure water used as the cleaning fluid during this process is also supplied from the polishing cloth center section, the above processing makes it possible to efficiently remove any abrasive fluid out of the copper film on the wafer. This pure-water washing process may be done for about 10 to 30 seconds.

Thereafter, the polishing head is pulled and separated from the wafer. The polishing head is subject to fiber recovery or refreshing treatment by the pad conditioner member. The pad conditioner has more than one rotatable pad conditioning disk which is driven to rotate and is then pressed onto the polishing cloth. The pad conditioning disk has a surface on which fine diamond particles having a diameter of 50 to 500 micrometer are electrolytically deposited, or buried in glass. This diamond file is used to perform the fiber recovery of the polishing cloth. Either abrasive fluid or pure water is supplied from the center part of the polishing cloth. The disk is such that fine diamond particles is formed along the outer periphery of the pad conditioning disk defining a band shape of 1 cm wide. One feature is that the polishing cloth faces downward whereas the diamond electrolytic deposited surface faces upward to thereby guarantee that even if some diamond particles drop down from the disk, such hardly reside on the polishing cloth. Another feature is that after completion of pad conditioning process, the pad cleaning means automatically washes the polishing cloth surface to maintain cleanliness of the polishing cloth surface.

During execution of the pad conditioning process, the index table is rotated by 90 degree. As a result, the wafer W is shifted to the secondary polishing station S3. This rotation permits supplement of a new wafer to the primary polishing station S2.

In the secondary polishing station S3, the polishing head is enclosed by a hood during polishing. The cleaning fluid is continuously fed to the inner wall of the hood during polishing process of a wafer to thereby eliminate hardening of a splashed abrasive fluid along with vaporization of liquid components of the abrasive fluid, in a way similar to that of the primary polishing station. When the cleaning water fed from the water seal room is supplied from the outside of the vacuum chuck, it is possible to eliminate immersion or "invasion" of the abrasive fluid to the wafer back surface during polishing.

The polishing head of the secondary polishing station S3 is provided with a soft polishing cloth stretched thereon. For example, a foam-urethane sheet having a high expansion ration or a polishing cloth made of the chemical fiber type such as polyester may be used. At the secondary polishing process step, the holder supporting a wafer is rotated at a rate of 50 to 300 rpm. The polishing head rotating at 50 to 1000 rpm is reciprocated over the wafer at a speed of 0.1 to 5 cm/second. The copper film 110 is gradually reduced in thickness by polishing. As the abrasive fluid supplied from the center part of the polishing head, a water solution of oxidizer is used which contains water-soluble organic polymer molecule such as cellulose of 0.1 to 1 wt % and silica particles at 5 to 10 wt % dissolved together. The water-soluble organic polymer molecule tends to be adsorbed in the surface of the copper film after polishing. The copper surface exhibits hydrophilia to offer the effect of suppressing drying/hardening of abradant particles. One specific case has been indicated in which the polishing cloth and abrasive fluid species are changed at the secondary polishing station S3 with those different from the ones used in the primary polishing station. Alternatively, it will be possible that no such abrasive members are changed while the polishing criteria or conditions are modified in a way such that the polish pressure is further decreased with the polishing head rotation speed being increased.

The secondary, polishing station S3 is provided with a photometer which detects a change in reflectivity of laser light on the wafer surface. A high-pressure nitride gas or high-pressure air or pure water is blown onto the wafer at the laser light incident position thereof to thereby remove away any abrasive fluid residing on the wafer. The polishing end point is set at an instant at which the reflectivity is lowered due to complete polishing of the copper film on the low-dielectric-constant organic film at locations other than lead groove regions. In the automatic polishing apparatus of the this invention, the polishing head is designed to be less in diameter than a wafer and is capable of swingably move on the wafer. Therefore, it is possible to detect the polishing end point by constantly monitoring the surface condition of the wafer. In a process similar to the primary polishing station, the pad conditioner member and pad cleaning member are operable to perform conditioning and cleaning of the polishing cloth of the polishing head, respectively, in the secondary polishing station.

Figure 18:
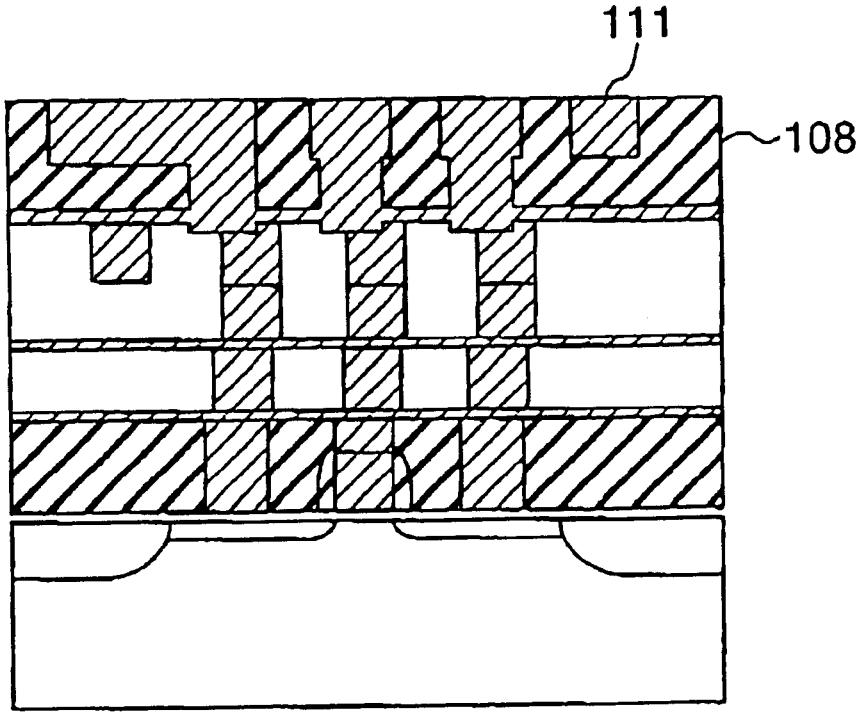
FIG. 18 shows a cross-sectional view for describing a copper film polished in a secondary polishing process

The polishing process in the secondary polishing station results in formation of a copper lead line 111 with copper buried in a lead groove of the organic film 108 as shown in FIG. 18.

In the unloading station S4, the holder consists of a vacuum chuck for supporting the wafer. The holder is rotated at a rate of about 50 rpm. The the brush of the wafer surface washing member is pressed onto the wafer in order to clean up the wafer. The brush rotates at the same rate of about 50 rpm. The cleaning fluid may be either pure water or electrolytic ionized water. After washing, the wafer is subjected to the back pressure of the air and pure water to the suction surface of the vacuum chuck to be released The robot arm transports the wafer onto the conveyer. The wafer has the copper film polished. The conveyer rapidly transfers the wafer to a scrub-cleaner device which carries out a next process.

In the automatic polishing apparatus described in the above embodiment, it becomes possible to perform, in a simultaneous/parallel manner, the wafer transfer process of wafers in the loading station S1, the surface planarization polishing process of a copper film in the primary polishing station S2, the removal/finish process of a copper film in the secondary polishing station S3, and the wafer transport process in the unloading station S4, while permitting rapid simultaneous transportation of a plurality of wafers to the next process step based on rotation of the index table in a predefined direction. In order to operate the automatic polishing apparatus of the this invention with maximal efficiency, It Is desirable that respective polishing criteria or conditions are appropriately set to ensure that the polish time duration of the primary polishing station is almost the same as that of the secondary polishing station. It is at least required that adjustments of respective polishing process start time points is done to guarantee that the end time of the primary polishing process is identical to the end time of the secondary polishing process.

Although the above embodiment is directed to the case of polishing the copper film on the low-dielectric-constant organic film, it is obvious that the principles of the invention is also applicable to polishing of an aluminum film on a silicon oxide film or a tungsten film thereon. Furthermore, the same may be applied to surface planarization of BPSG films or silicon oxide films. In this case, it will be possible to employ a hard polishing cloth and silica particle-distributed abrasive fluid for the primary polishing station and secondary polishing station thus permitting execution of planarization polishing in the both stations in a simultaneous/parallel fashion.

As readily understood from the above description, it is possible to increase efficiency of wafer polishing works by allowing respective stations assigned to the index table to perform wafer polishing and wafer transportation onto the index table as well as outward wafer delivery from the index table substantially simultaneously in a parallel processing manner. Furthermore, it is possible to attain continuous execution of polishing processing while constantly monitoring a change in surface status or condition due to wafer polishing.

In case where rough polishing and finish polishing are to be done sequentially on the same index table, it becomes possible to render the end time of the rough polishing identical to that of the finish polishing. As a result, it is possible to prevent wafers from being put in wait modes after completion of polish processing, which in turn leads to capability of eliminating a decrease in wafer quality otherwise occurring due to dry solidification of abrasive fluid. With the this invention, it is possible to effectuate any intended polishing process with respect to the individual one of wafers under the exactly same condition or criteria without requiring any extra wide spaces for installation of the polishing apparatus used, which in turn enables achievement of uniform products of enhanced quality.

The principles of the this invention may be widely applicable to various types of polishing processes for use with several kinds of glass materials, Si, $SiO_2$, various ceramics, gallium arsenide, indium phosphorus, sapphire, and any equivalents thereto

What is claimed is:

1. An automatic polishing apparatus for polishing a wafer into a polished wafer, comprising:

an index table for holding at least two wafers as first and second wafers at first and second predetermined locations, respectively, said index table being rotated at a predetermined angle around a predetermined rotation axis, each of said first and said second wafers having a front surface which is directed upwardly;

at least one polishing station which is positioned at a first stop position of said index table, said polishing station being a region for use in polishing each of said first and said second wafers into said polished wafer;

a polishing head being located above the index table at said polishing station, said polishing head having a polishing surface which is for polishing the front surface of each of said first and said second wafers transferred to said polishing station; and a hood enclosing said polishing head and adapted to continuously feed cleaning fluid to an inner wall of said hood during polishing in order to prevent hardening of abrasive fluid splashed from said polishing head.

2. An automatic polishing apparatus as claimed in claim 1, wherein said automatic polishing apparatus further comprises:

a loading station positioned at a second stop position of said index table for transferring said first and said second wafers to said first and said second predetermined locations, respectively; and an unloading station positioned at a third stop position for taking said polished wafer out of said index table.

3. An automatic polishing apparatus as claimed in claim 2, wherein said automatic polishing apparatus comprises wafer back-surface washing means for washing a back surface of each of said first and said second wafers.

4. An automatic polishing apparatus as claimed in claim 1, wherein said automatic polishing apparatus comprises wafer back-surface washing means for washing a back surface of each of said first and said second wafers.

5. An automatic polishing apparatus as claimed in claim 1, wherein said polishing head has fluid supplying means for supplying abrasive fluid to said polishing surface.

6. An automatic polishing apparatus as claimed in claim 5, wherein said fluid supplying means is a hole which formed in said polishing head.

7. An automatic polishing apparatus for polishing a wafer into a polished wafer, comprising:

an index table for holding at least two wafers as first and second wafers at first and second predetermined locations, respectively, said index table being rotatable at a predetermined angle around a predetermined rotation axis, each of said first and said second wafers having a front surface which is directed upwardly;

at least one polishing station which is positioned at a first stop position of said index table, said polishing station being a region for polishing each of said first and said second wafers into said polished wafer;

a polishing head being located above the index table at said polishing station, said polishing head having a polishing surface for polishing the front surface of each of said first and said second wafers transferred to said polishing station; and a hood enclosing said polishing head and adapted to continuously feed cleaning fluid to an inner wall of said hood during polishing in order to prevent hardening of abrasive fluid splashed from said polishing head.

8. An automatic polishing apparatus as claimed in claim 7, wherein said automatic polishing apparatus further comprises:

a loading station positioned at a second stop position of said index table for transferring said first and said second wafers to said first and said second predetermined locations, respectively; and an unloading station positioned at a third stop position for taking said polished wafer out of said index table.

9. An automatic polishing apparatus as claimed in claim 8, wherein said automatic polishing apparatus further comprises wafer back-surface washing means for washing a back surface of each of said first and said second wafers.

10. An automatic polishing apparatus as claimed in claim 8, wherein said index table comprises a plurality of holders for supporting said first and said second wafers, respectively, said holders being adapted to rotate said first and said second wafers at the polishing station to polish said first and said second wafer, respectively.

11. An automatic polishing apparatus as claimed in claim 10, wherein:

each of said holders is a vacuum chuck for supporting either one of said first and said second wafers;

said automatic polishing apparatus further comprising chuck washing means for washing a suction surface of said vacuum chuck before transporting each of said first and said second wafers to said index table.

12. An automatic polishing apparatus as claimed in claim 7, wherein said index table comprises a plurality of holders for supporting said first and said second wafers, respectively, said holders being adapted to rotate said first and said second wafers at the polishing station to polish said first and said second wafer, respectively.

13. An automatic polishing apparatus as claimed in claim 7, wherein said automatic polishing apparatus further comprises wafer back-surface washing means for washing a back surface of each of said first and said second wafers.

14. An automatic polishing apparatus as claimed in claim 7, wherein said automatic polishing apparatus further comprises:

pad conditioner means for refreshing the polishing surface of said polishing head; and pad cleaning means for removing abrasive powders and abrasive particles residing on said polishing head to clean up said polishing head after refreshing said polishing head.

15. An automatic polishing apparatus as claimed in claim 7, wherein said automatic polishing apparatus further comprises wafer surface washing means for washing the front surface of each of said first and said second wafers after polishing each of said first and said second wafers.

16. An automatic polishing apparatus as claimed in claim 7, wherein said polishing station comprises:

a primary polishing station for use in carrying out a planarization process to roughly polish each of said first and said second wafers; and a secondary polishing station for carrying out a finish polishing process to finally polish each of said first and said second wafers.

17. An automatic polishing apparatus as claimed in claim 7, wherein said polishing head has a diameter that is less than that of each of said first and said second wafers.

18. An automatic polishing apparatus as claimed in claim 7, wherein said polishing head is adapted to swing in three-dimensions, the polishing surface maintaining a parallel attitude with respect to each of said first and said second wafers on polishing.

19. An automatic polishing apparatus as claimed in claim 7, wherein said polishing head has fluid supplying means for supplying abrasive fluid to said polishing surface.

20. An automatic polishing apparatus as claimed in claim 17, wherein said fluid supplying means is a hole which formed in said polishing head.

21. An automatic polishing apparatus as claimed in claim 7, further comprising wafer surface detection means for detecting an end time of the wafer surface polishing process in accordance with a change in wafer surface condition.

22. An automatic polishing apparatus for polishing a wafer into a polished wafer, comprising:

an index table for holding at least two wafers as first and second wafers at first and second predetermined locations, respectively, said index table being rotatable at a predetermined angle around a predetermined rotation axis, each of said first and said second wafers having a front surface which is directed upwardly; at least one polishing station positioned at a first stop position of said index table, said polishing station being a region for polishing each of said first and said second wafers into said polished wafer; and a polishing head being located above the index table at said polishing station, said polishing head having a polishing surface for polishing the front surface of each of said first and said second wafers transferred to said polishing station;

said polishing head swinging in three-dimensional directions, the polishing surface maintaining a parallel attitude with respect to each of said first and said second wafers on polishing.

23. An automatic polishing apparatus as claimed in claim 22, wherein said automatic polishing apparatus further comprises:

a loading station positioned at a second stop position of said index table for transferring said first and said second wafers to said first and said second predetermined locations, respectively; and an unloading station positioned at a third stop position for taking said polished wafer out of said index table.

24. An automatic polishing apparatus as claimed in claim 22, wherein said automatic polishing apparatus further comprises wafer back-surface washing means for washing a back surface of each of said first and said second wafers.

25. An automatic polishing apparatus as claimed in claim 23, wherein said index table comprises a plurality of holders for supporting said first and said second wafers, respectively, said holders being adapted to rotate said first and said second wafers at the polishing station to polish said first and said second wafer, respectively.

26. An automatic polishing apparatus as claimed in claim 25, wherein each of said holders is a vacuum chuck which supports either one of said first and said second wafers and said automatic polishing apparatus further comprises chuck washing means for washing a suction surface of said vacuum chuck before transporting each of said first and said second wafers to said index table.

27. An automatic polishing apparatus as claimed in claim 22, wherein said index table comprises a plurality of holders for supporting said first and said second wafers, respectively, said holder being adapted to rotate said first and said second wafers at the polishing station to polish said first and said second wafer, respectively.

28. An automatic polishing apparatus as claimed in claim 22, wherein said automatic polishing apparatus further comprises wafer back-surface washing means for washing a back surface of each of said first and said second wafers.

29. An automatic polishing apparatus as claimed in claim 22, wherein said automatic polishing apparatus further comprises:

pad conditioner means for refreshing the polishing surface of said polishing head; and pad cleaning means for removing abrasive powders and abrasive particles residing on said polishing head to clean up said polishing head after refreshing said polishing head.

30. An automatic polishing apparatus as claimed in claim 22, wherein said automatic polishing apparatus further comprises wafer surface washing means for washing the front surface of each of said first and said second wafers after polishing each of said first and said second wafers.

31. An automatic polishing apparatus as claimed in claim 22, wherein said polishing station further comprises:

a primary polishing station for carrying out a planarization process to roughly polish each of said first and said second wafers; and a secondary polishing station for carrying out a finish polishing process to finally polish each of said first and said second wafers.

32. An automatic polishing apparatus as claimed in claim 22, wherein said polishing head has a diameter that is less than that of each of said first and said second wafers.

33. An automatic polishing apparatus as claimed in claim 22, wherein said polishing head has fluid supplying means for supplying abrasive fluid to said polishing surface.

34. An automatic polishing apparatus as claimed in claim 22, wherein said fluid supplying means is a hole which formed in said polishing head.

35. An automatic polishing apparatus as claimed in claim 22, wherein said automatic polishing apparatus further comprises wafer surface detection means for detecting an end time of the wafer surface polishing process in accordance with a change in wafer surface condition.

* * * * *

UNITED STATES PATENT AND TRADEMARK OFFICE

CERTIFICATE OF CORRECTION

PATENT NO. : 6,379,230 B1 
DATED : April 30, 2002
INVENTOR(S) : Yoshihiro Hayashi and Kazuo Kobayashi It is certified that error appears in the above-identified patent and that said Letters Patent is hereby corrected as shown below:

Title page,
Item [73], Assignee: please delete "NEC Corporation" please insert -- NEC Corporation and Nikon Corporation --

Signed and Sealed this

Fifth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,379,230 B1 
DATED : April 30, 2002
INVENTOR(S) : Yoshihiro Hayashi and Kazuo Kobayashi It is certified that error appears in the above-identified patent and that said Letters Patent is hereby corrected as shown below:

Column 1,
Line 27, delete “rhe” and insert therefor -- the --.

Column 2,
Line 20, delete “second chuck which is associated with the second-”.
Lines 21-30, delete in their entirety.

Column 3,
Line 48, delete “that the metal film 52 fill the lead”.
Lines 49-56, delete in their entirety.

Column 5,
Line 25, delete “if” and insert therefor -- 1*f* --.
Line 28, delete “id” and insert therefor -- 1*d* --.
Line 44, delete “Use” and insert therefor -- use --.

Column 6,
Line 66, after “25” insert -- . --.

Column 7,
Line 9, delete “In” and insert therefor -- in --.

Column 8,
Line 29, delete “Is” and insert therefor -- is --.

Column 9,
Line 54, delete “MOSPETs” and insert therefor -- MOSFETs --.
Line 57, delete “MOSPET” and insert therefor -- MOSFET --.

Column 10,
Line 65, after “grooves” insert -- . --.

Column 12,
Line 28, delete “Include” and insert therefor -- include --.

UNITED STATES PATENT AND TRADEMARK OFFICE

CERTIFICATE OF CORRECTION

PATENT NO. : 6,379,230 B1 
DATED : April 30, 2002
INVENTOR(S) : Yoshihiro Hayashi and Kazuo Kobayashi It is certified that error appears in the above-identified patent and that said Letters Patent is hereby corrected as shown below:

Column 14,
Line 55, delete “It Is” and insert therefor -- it is --.

Column 15,
Line 35, after “thereto” insert -- . --.

Signed and Sealed this

Tenth Day of December, 2002

JAMES E. ROGAN
*Director of the United States Patent and Trademark Office*